United States Patent [19]

Abdel-Messeh

[11] Patent Number: 5,052,889

[45] Date of Patent: Oct. 1, 1991

[54] OFFSET RIBS FOR HEAT TRANSFER SURFACE

[75] Inventor: William Abdel-Messeh, Beloeil, Canada

[73] Assignee: Pratt & Whintey Canada, Longeueil, Canada

[21] Appl. No.: 524,529

[22] Filed: May 17, 1990

[51] Int. Cl.[5] ..... F01D 5/18

[52] U.S. Cl. ..... 416/97 R; 415/115; 165/170

[58] Field of Search ..... 165/166, 167, 170; 416/97 R; 415/115

[56] References Cited

U.S. PATENT DOCUMENTS 2,566,928 9/1951 Carter ..... 165/166
3,151,675 10/1964 Lysholm ..... 165/166
3,741,285 6/1973 Kuethe ..... 165/1
4,176,713 12/1979 Fisher ..... 165/166
4,416,585 11/1983 Abdel-Messeh ..... 416/97 R

OTHER PUBLICATIONS

Transactions of ASME, Journal of heat transfer, vol. 100, p. 520, Aug. 1978, J. M. Bentley, T. K. Snyder, L. R. Glicksman, W. M. Rohsenow.

*Primary Examiner*—Albert W. Davis, Jr.
*Attorney, Agent, or Firm*—Troxell K. Snyder

[57] ABSTRACT

Augmenting ribs (40) of zig-zag configuration are provided on a heat transfer surface (38) for increasing local heat transfer in a selected zone (68,70) of the surface (38).

8 Claims, 1 Drawing Sheet

FIG. 1
PRIOR ART
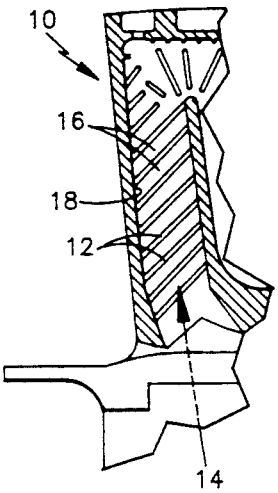
FIG. 2
PRIOR ART
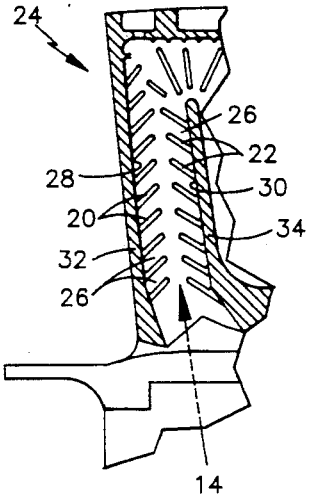
FIG. 3
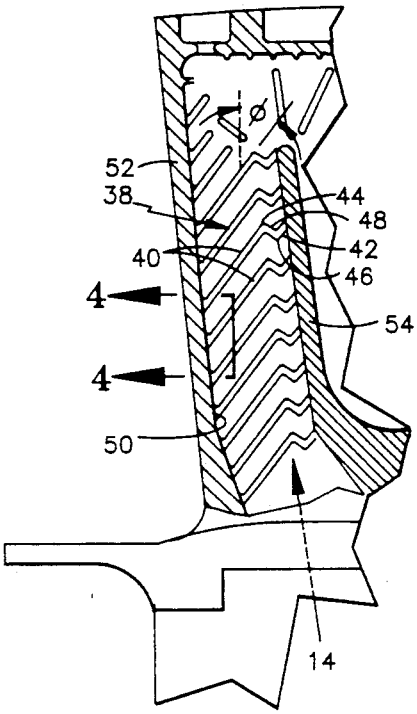
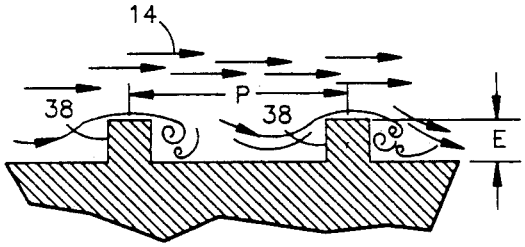
FIG. 4
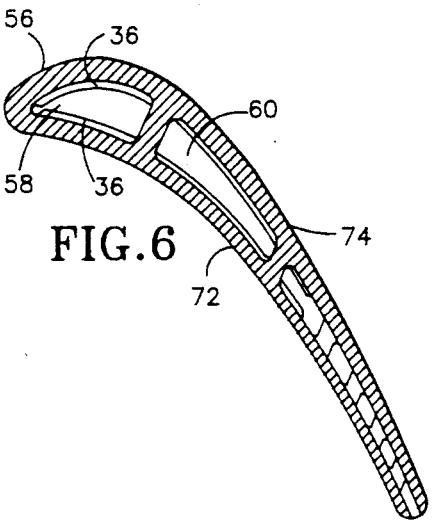
FIG. 6
FIG. 5
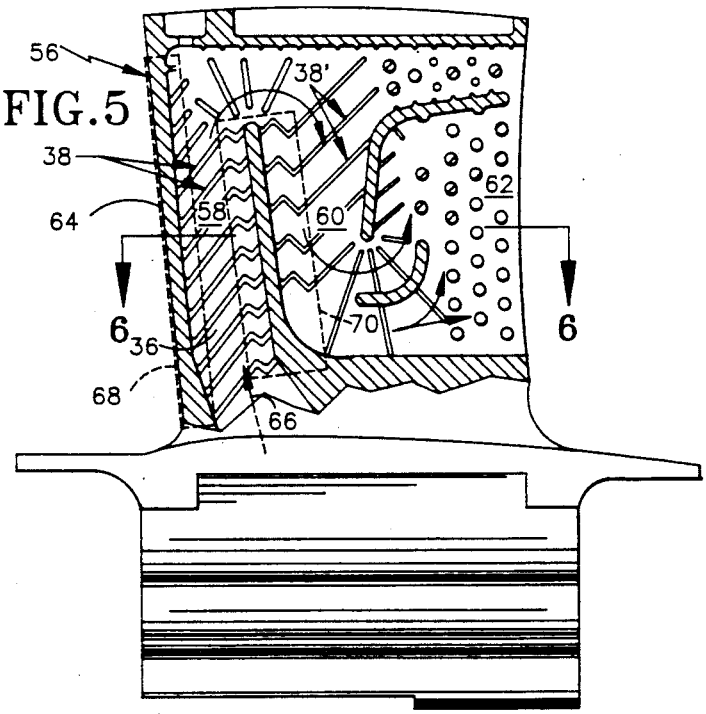

OFFSET RIBS FOR HEAT TRANSFER SURFACE

FIELD OF THE INVENTION

The present invention relates to a configuration of roughening ribs for a heat transfer surface.

BACKGROUND

Heat transfer between a surface and an adjacent gas stream flowing substantially parallel thereto is affected by a variety of factors, including gas velocity, surface roughness, gas density, etc. It is known in the art to use roughening ribs or ridges disposed generally transversely with respect to the flow direction of the adjacent gas stream for the purpose of augmenting overall heat transfer coefficients and rates. Such roughening ribs may be disposed perpendicularly, skewed, or in chevrons as disclosed in U.S. Pat. No. 4,416,585 issued to Abdel-Messeh. Such configurations, while generally increasing overall heat transfer coefficient and hence rates, do not provide consistent or determinable augmentation of local heat transfer coefficient between the surface and the adjacent gas stream.

For certain applications, and in particular for internally cooled gas turbine airfoils exposed to an external stream of high temperature turbine working fluid, it is particularly desirable to minimize the flow of internal cooling gas through the turbine blade while still maintaining thermal protection at the external blade surface. As will be appreciated by those skilled in the art of turbine blade cooling, the heat loading at the exterior of the blade is not uniform with chordal displacement, having a peak at the leading edge of the blade and subsequent intermediate peaks at various locations disposed along the pressure and suction sides of each individual blade. Prior art heat transfer augmenting ribs are typically sized to achieve sufficient overall internal heat transfer rates so as to protect the high heat load zones of the blade, thereby overcooling other, lesser loaded zones.

A heat transfer augmenting configuration which permits the designer to allocate and vary heat transfer augmentation transversely with respect to the cooling gas flow would achieve protection of the blade exterior at reduced overall internal cooling mass flow.

SUMMARY OF THE INVENTION

According to the present invention, a plurality of roughening ribs are provided on a heat transfer surface for disrupting the boundary layer of a stream of gas flowing generally parallel to the surface. The roughening ribs increase local turbulence in the gas flow, thereby increasing both local and overall surface heat transfer coefficient.

The present invention also provides for transversely varying local heat transfer coefficient with respect to the gas flow direction by providing each rib with two parallel, but offset end portions, connected at the proximate ends of each, to a third intermediate portion which is oriented approximately perpendicular to the end portions. Test results have shown that this "zig-zag" or "N-shaped" ridge of the present invention provides increased local heat transfer not only at the upstream end of each ridge, but also at each end of the intermediate portion, without increasing the overall gas side frictional pressure loss or diverting the bulk of the gas flow laterally as compared to prior art roughening ribs configurations.

The rib configuration of the present invention is particularly well suited for the internal surface of a cooling conduit in a gas cooled airfoil. Opposite internal conduit surfaces provided with roughening ribs according to the present invention may be "tailored" to match the local internal heat transfer coefficient with the expected external thermal loading on the airfoil suction and pressure sides. A turbine airfoil provided with a tailored internal heat transfer surface would thus achieve maximum cooling protection with the least flow of internal cooling fluid. Increased operating efficiency with minimal costs is the result.

BRIEF DESCRIPTION OF THE DRAWINGS

FIG. 1 shows a plan view of a prior art skew heat transfer surface with skewed ridges.

FIG. 2 shows a plan view of a prior art heat transfer surface with chevron ridges.

FIG. 3 shows a plan view of a heat transfer surface according to the present invention.

FIG. 4 shows a sectional view of the surface of FIG. 3.

FIG. 5 shows a spanwise sectional view of the internal cooling arrangement of the turbine airfoil.

FIG. 6 shows a sectional view of the airfoil of FIG. 5 as indicated therein.

DETAILED DESCRIPTION

FIG. 1 shows a heat transfer surface 10 which includes a plurality of trip strips or ridges 12 extending generally laterally with respect to a flow of gas 14 moving parallel to the surface 10. The strips 12 interrupt the boundary layer of the gas moving adjacent the flat portion 16 of the surface 10, thereby increasing turbulence as well as the local convective heat transfer coefficient between the surface 10 and the gas stream 14.

As is well known in the art, the local heat transfer coefficient for the arrangement of FIG. 1 is highest at the upstream ends 18 of the individual ridges 12. The remainder of the surface 10 not in the vicinity of the upstream ends 18 achieves a substantially uniform heat transfer coefficient.

FIG. 2 shows a prior art chevron arrangement of ridges 20, 22 disposed in a surface 24. Again the ridges 20, 22 disrupt the boundary layer of the flowing gas 14 moving generally parallel to the flat portion 26 of the surface 24, augmenting both local and overall heat transfer coefficient. The chevron style, as with the skewed arrangement shown in FIG. 1, also provides for a locally elevated heat transfer coefficient in the vicinity of the upstream ends 28, 30 of the individual ridges 20, 22. One drawback which occurs, however, with the use of chevron style arrangement of FIG. 2 is the diversion of the gas stream 14 away from the lateral edges 32, 34 of the surface 24 toward the center as a result of the chevron arrangement 20, 22. The diverted gas stream is thus reduced in velocity adjacent the edges 32, 34 resulting in a concurrent decrease in local heat transfer rate.

It is known, in a channel arrangement wherein the gas flow 14 is confined between two opposite facing surfaces, to provide oppositely skewed chevrons on each of the facing surfaces thereby preventing the channeling of the gas stream 14. Such arrangement, while effective in reducing the channeling for diversion of the gas stream 14 toward the center of the surface 14 is also effective in increasing the uniformity of heat transfer coefficient over the entire heat transfer surface 24, thereby reducing the ability of the designer to tailor the local heat transfer coefficient of the surface 24 to achieve a locally varying heat flux distribution.

FIG. 3 shows a plan view of a heat transfer surface 36 according to the present invention. A plurality of ridges 38 extend generally laterally across the gas stream 14. The ridges 38 are spaced streamwisely with respect to the gas flow 14, with each ridge 38 including three distinct portions. Each ridge 38 includes a first end portion 40, a second end portion 42, aligned generally parallel with the first portion 40 but offset with respect thereto as shown in FIG. 3. Connecting the proximate ends 44, 46 of the respective first and second end portions 40, 42 is an intermediate portion or segment 48 which is preferably oriented perpendicular to the end portions and in the range of $\frac{1}{3}$ to $\frac{1}{4}$ of the width of the heat transfer surface 36 measured perpendicular to the gas flow.

The resulting form, termed herein "zig-zag" or "N-shaped" ridge 38 provides heretofore unrealized opportunities for tailoring the local heat transfer coefficient in a heat transfer 36. For ridges having end portions skewed by an angle $\phi$ with respect to the general direction of the gas flow 14, it has been determined experimentally that locally elevated heat transfer coefficient in the vicinity of the upstream ends 50 of the first segments 40, as well as in the vicinity of the proximate ends 44, 46 of the first and second end portions 40, 42. Thus, a designer may locate the intermediate segments 44 of a plurality of heat augmenting ridges 38 according to the present invention so as to achieve a region of elevated heat transfer characteristics intermediate the lateral sides 52, 54 of the heat transfer surface 36.

The angle $\phi$ between the flowing gas 14 and the end portions 40, 42 is preferably 45° as shown in FIG. 3, but may vary between 30° and 60° and still achieve the desired local augmentation. In terms of the height and spacing of the ridges 38 relative to the intermediate surface 56 and gas stream 14, FIG. 4 shows the indicated cross-sectional view taken in FIG. 3. The height E and spacing P of the individual ridges 38 can vary depending on the degree of augmentation of the surface heat transfer coefficient desired. It has been found that a ratio of P/E of approximately 4 is the most effective in increasing the surface heat transfer coefficient with the least increase of gas side pressure loss, however, ratios of P to E as great as 15 have been found likewise effective. In general, the linear spacing of the ridges 38 is a function of the desired degree of augmentation of heat transfer with decreasing spacing resulting in increased overall and local heat transfer coefficients. In some circumstances, manufacturing capability may dictate the minimum height and hence, minimum spacing of the ridges 38.

FIG. 5 shows a turbine blade 56 having a plurality of serpentine interior passages 58, 60, 62 for conducting a flow of cooling air 66 through the interior of the blade 56 for the purpose of protecting the blade surface and material from externally flowing high temperature fluid. Such internally cooling blades are common in gas turbine technology with the internal passages and cooling gas flow rate sized to maintain the blade airfoil surface below temperatures at which substantial oxidation or other deterioration is known to occur.

As will be appreciated by those skilled in the art of blade cooling, the external heat loading of a blade airfoil is non-uniform, particularly with respect to chordal displacement. Thus, high heat loading represented by elevated heat flux at the blade surface occurs at the blade leading edge 64 as well as additional locations spaced chordally from the leading edge 64.

Prior art practice using augmented heat transfer surfaces such as those shown in FIGS. 1 and 2 provide increased overall interior heat transfer coefficient within the internal passages 58, 60. Such increased overall heat transfer can result in overcooling of certain regions of the turbine blade, thus, resulting in a decrease in overall engine fuel and operating efficiency.

By using a heat transfer surface 36 having zig-zag ridges 38 according to the present invention, a designer may tailor the local heat transfer coefficient of the interior surface of the blade cooling channels 58, 60 so as to provide increased internal heat transfer coefficients conchordally with those regions on the exterior blade surface which are likely to be subject to increased heat loading. Thus, the arrangement of trip strips 38, 38' in passages 58, 60 of the blade 56 results in a region 68 of locally increased heat transfer coefficient adjacent the leading edge 64 of the airfoil 56 and a secondary region 70 of locally increased heat transfer coefficient spaced chordally with respect to the first region 68.

By tailoring the local heat transfer coefficient so as to match the blade airfoil exterior heat loading, the heat transfer surface 36 according to the present invention provides increased local heat transfer rates and hence, cooling, at exactly the locations necessary to protect the blade material. By thus avoiding overcooling of the areas of the blade not subject to elevated heat loading, the surface 36 according to the present invention permits a reduction in blade internal gas coolant flow 60, thereby increasing overall engine efficiency without sacrificing blade servico life.

As will be appreciated by thos skilled in the art, opposing interior surfaces 36, 36' which define the internal cooling channels 58, 60 of an airfoil 56 as shown in cross section in FIG. 6 may be provided with individually configured ridges 38 so as to particularly address the individual heat loading of the pressure 72 and suction 74 sides of the blade 56.

What is claimed:

1. Means for preferentially augmenting the local heat transfer coefficient of two heat transfer surfaces defining an internal, spanwisely extending cooling channel in an airfoil body having an external suction side and an external pressure side and a flow of gas therethrough, comprising a plurality of ridges disposed on the first surface and the second surface and spaced streamwisely with respect to the gas flow, each ridge including a first end portion extending generally laterally with respect to the gas flow, a second end portion parallel to the first portion, the second end portion further being offset with respect to the first portion, and an intermediate portion, extending between the proximate ends of the first and second end portions, and oriented substantially perpendicular thereto, and wherein the upstream end of the first portions of the first surface plurality of ridges are located adjacent a first region of the suction side subject to elevated thermal loading, and wherein, the upstream ends of the first portions of the second surface plurality of ridges are located adjacent a first region of the pressure side subject to elevated thermal loading, and wherein the intermediate segments of the first surface ridges are located concordally with a second region of the suction side subject to elevated thermal loading, and wherein the intermediate segments of the second surface ridges are located concordally with a second region of the pressure side subject to elevated thermal loading.

2. The augmenting means as recited in claim 1, wherein the first and second end portions are skewed with respect to the gas flow.

3. The augmenting means as recited in claim 2 wherein the angle of the skewed ridges with respect to the gas flow is in the range of 30 to 60 degrees.

4. The augmenting means as recited in claim 3 wherein the skew angle is 45 degrees.

5. The augmenting means as recited in claim 1 wherein the ratio of the streamwise spacing of adjacent ridges to the height of each ridge above the surrounding heat transfer surface is in the range of 4 to 15.

6. The augmenting means as recited in claim 1 wherein the ridges of the second heat transfer surface are each disposed streamwisely intermediate adjacent ridges on the first heat transfer surface.

7. The augmenting means as recited in claim 1 wherein the length of the intermediate segment is in the range of $\frac{1}{3}$ to $\frac{1}{4}$ the width of the corresponding heat transfer surface measured locally perpendicular to the gas flow direction.

8. The augmenting means as reciting in claim 1, wherein the suction side first region and the pressure side first region are adjacent the leading edge of the airfoil body.

* * * * *